US006257714B1

(12) United States Patent
Seccombe

(10) Patent No.: US 6,257,714 B1
(45) Date of Patent: Jul. 10, 2001

(54) METHOD AND APPARATUS FOR REMOVING AIR FROM AN INKJET PRINT CARTRIDGE

(75) Inventor: S. Dana Seccombe, Foster City, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/107,082

(22) Filed: Jun. 29, 1998

Related U.S. Application Data

(63) Continuation-in-part of application No. 08/549,104, filed on Oct. 27, 1995, now Pat. No. 5,812,155.

(51) Int. Cl.[7] ..... B41J 2/19

(52) U.S. Cl. ..... 347/92; 347/6; 347/29; 347/30; 347/86; 347/87

(58) Field of Search ..... 347/6, 29, 30, 347/92, 86, 87, 35

(56) References Cited

U.S. PATENT DOCUMENTS

| | | | | |
|---|---|---|---|---|
| 4,536,777 | * | 8/1985 | Matsumoto | 347/92 |
| 4,631,556 | * | 12/1986 | Watanabe et al. | 347/30 |
| 4,967,207 | | 10/1990 | Ruder | 346/140 R |
| 4,968,998 | | 11/1990 | Allen | 346/140 R |
| 4,982,199 | | 1/1991 | Dunn | 346/1.1 |
| 5,185,614 | | 2/1993 | Courian et al. | 346/1.1 |
| 5,363,130 | | 11/1994 | Cowger et al. | 347/92 |

FOREIGN PATENT DOCUMENTS

| | | | |
|---|---|---|---|
| 0448967A1 | 10/1991 | (EP) | B41J/2/165 |
| 2202799A | 10/1988 | (GB) | B41J/3/04 |
| 63-145039 | 6/1988 | (JP) | B41J/3/04 |

OTHER PUBLICATIONS

Altavela et al., Xerox Disclosure Journal, "Printhead ink supply configuration for the removal of air trapped in the die inlet region", vol. 19, No. 3, 1994, pp. 213–214.

* cited by examiner

*Primary Examiner*—John Barlow
*Assistant Examiner*—Manish S. Shah
(74) *Attorney, Agent, or Firm*—Raymond A. Jenski

(57) ABSTRACT

Method and apparatus for removing air from an inkjet print cartridge by collecting the air in a predetermined area and forcing the air from the air collection area using a conduit.

10 Claims, 8 Drawing Sheets

METHOD AND APPARATUS FOR REMOVING AIR FROM AN INKJET PRINT CARTRIDGE

This application is a continuation-in-part of U.S. patent application Ser. No. 08/549,104 filed on Oct. 27, 1995 now U.S. Pat. No. 5,812,155, on behalf of S. Dana Seccombe and assigned to the assignee of the present application.

BACKGROUND OF THE INVENTION

The present invention relates generally to the field of inkjet printing and, more particularly, to the delivery of ink to inkjet print heads.

Inkjet technology is relatively well developed. The basics of this technology are described by W. J. Lloyd and H. T. Taub in "Ink-jet Devices," Chapter 13 of *Output Hardcopy Devices* (Ed. R. C. Durbeck and S. Sherr, Academic Press, San Diego, 1988) and in various articles in the *Hewlett-Packard Journal,* Vol. 36, No. 5 (May 1985), Vol. 39, No. 4 (August 1988), Vol. 39, No 5 (October 1988), Vol. 43, No. 4 (August 1992), Vol. 43, No. 6 (December 1992) and Vol. 45, No. 1 (February 1994).

The typical thermal inkjet print head has an array of precisely formed nozzles attached to a print head substrate that incorporates an array of firing chambers that receive liquid ink (i.e., colorants dissolved or dispersed in a solvent) from an ink reservoir. Each chamber has a thin-film resistor, known as a "firing resistor", located opposite the nozzle so ink can collect between it and the nozzle. When electric printing pulses heat the thermal inkjet firing resistor, a small portion of the ink near it vaporizes and ejects a drop of ink from the print head. The nozzles are arranged in a matrix array. Properly sequencing the operation of each nozzle causes characters or images to form on the paper as the print head moves past the paper.

Air that is trapped in print cartridges has become an increasingly troublesome problem. In the past the accumulation of air in print cartridges was mainly ignored because the cartridges were large and could easily warehouse the air and because the cartridges had short operating lives and significant amounts of air did not accumulate. However, in today's advanced print cartridge designs the passage ways, particle filters, orifices, and conduits have become smaller and smaller. With these smaller dimensions air and air bubbles tend to block the flow of ink through the print cartridge and cause the nozzles not to eject ink. This leads to failure of the print cartridge and to require its premature replacement.

Air becomes entrapped in print cartridges from a plurality of sources. Initially air is present because it was not fully purged during manufacturing. Secondly, air bubbles may have been present during assembly in the ink tubes connecting the print head with the ink reservoir. After manufacture and for the life of the print cartridge, any dissolved air in the ink comes out of solution as bubbles. Further, air permeates into the print cartridge through the ink containment materials. Finally, in some circumstances air may be ingested into the print cartridge through the nozzles.

For a myriad of reasons the presence of air and air bubbles in inkjet print cartridges, which was previously ignored now dictates that air management become one of the factors influencing modern inkjet cartridge design.

One system for removing air from an inkjet print cartridge is described in U.S. Pat. No. 4,968,998 to Allen issued on Nov. 6, 1990.

SUMMARY OF THE INVENTION

Briefly and in general terms, an apparatus according to the present invention includes a predetermined collection area for air within a print cartridge. Air is removed from this area by a conduit that draws off the air either through the print head or through a conduit in a wall of the print cartridge. A method according to the present invention includes the steps of collecting the air in a predetermined area, removing the air using the conduit, and replacing the air being removed with ink.

In another embodiment, an apparatus according to the present invention includes a first conduit in fluid communication with the air collection area and a second conduit in fluid communication with the ink flow path. The apparatus further includes means for shifting between the first and second conduits so that air from the collection area is removed from the print cartridge through the first conduit and ink is directed through the flow path in the print cartridge through the second conduit.

Other aspects and advantages of the invention will become apparent from the following detailed description, taken into conjunction with the accompanying drawings, illustrating by way of example the principles of the invention.

DETAILED DESCRIPTION OF THE INVENTION

Figure 1:
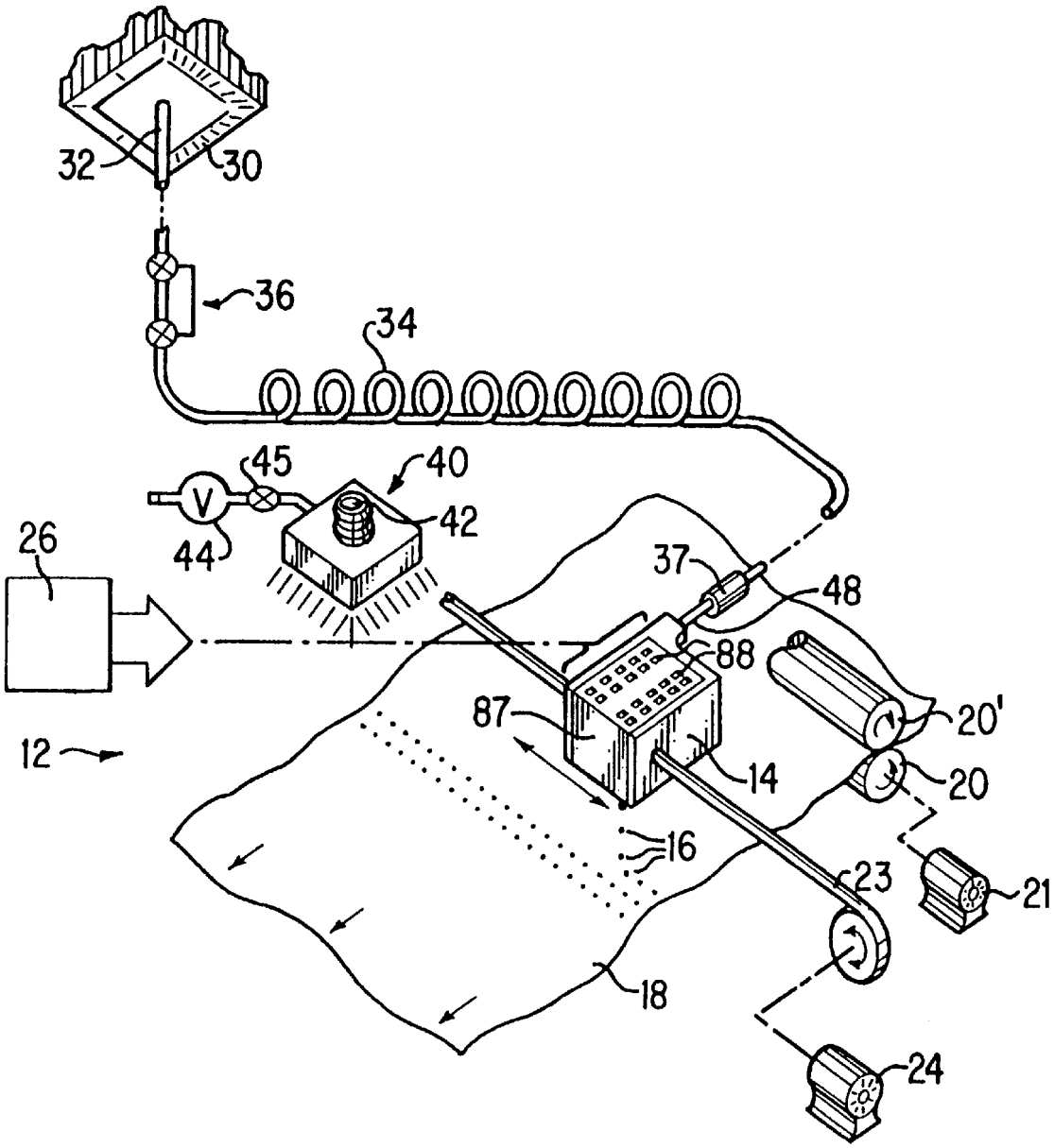
FIG. 1 is a diagrammatic, perspective view of an inkjet printer according to the present invention.

As shown in the drawings for the purposes of illustration, the invention is embodied in a method and apparatus for removing air from a print cartridge using a conduit in fluid communication with a predetermined collection area for air in the print cartridge.

Referring to FIG. 1, reference numeral 12 generally indicates a printer including a print cartridge 14 that ejects drops 16 of ink on command. The drops form images on a printing medium 18 such as paper. The printing medium is moved laterally with respect to the print cartridge 14 by two print rollers 20, 20' and a motor 21 that engages the printing medium. The print cartridge is moved back and forth across the printing medium by a drive belt 23 and a motor 24. The print cartridge contains a plurality of firing resistors, not shown, that are energized on command by an electrical circuit 26. The circuit sequentially energizes the firing resistors in a manner so that as the print cartridge 14 moves laterally across the paper and the paper moved by the rollers 20, 20', the drops 16 form images on the printing medium 18.

Referring to FIG. 1, ink is supplied to the print cartridge 14 from an ink reservoir 30. The ink reservoir is stationary and may be either flaccid or pressurized. The ink is supplied from the reservoir by an integral connector 32 that is removably attached to a conduit 34 by a double acting valve 36. The connector 32 allows the reservoir to be replaced when the ink supply is exhausted. The ink in the reservoir is maintained at a pressure sufficient to maintain the flow of ink through the conduit 34 necessary to meet the maximum ink flow requirements of the print cartridge (which could be from −20 inches to +100 inches of water). This pressure also depends on the diameter and length of the conduit 34. The conduit has a generally helical shape to accommodate the motion of the print cartridge 14 with respect to the ink reservoir 30. When the connector is separated from the conduit, the double acting valve 36 simultaneously shuts both openings so that air is not ingested into the system. Likewise when the connector is fitted to the conduit, the double acting valve simultaneously opens both the connector 32 and the conduit 34 to allow fluid communication of the ink between the ink reservoir 30 and the print cartridge 14 without ingesting air into the system.

The conduit 34, FIG. 1 terminates in a particle filter 37 that collects any material that could clog the print cartridge 14 during operation. The filter is located on the high pressure side of the ink pressure regulator so that if any air is ingested in the reservoir 30, at the double acting valve 36 or in the conduit 34, the higher pressure will force the air to flow into the print cartridge and not become caught up in the filter and impede the ink flow.

The printer 12, FIG. 1, also includes a service station 40 that can draw a vacuum on the nozzles, not shown, on the print cartridge 14, or alternatively, pressurize the print cartridge. The service station includes a deformable cup 42 that engages and seals against the nozzles. In one embodiment, the cup is connected to a source of vacuum 44 by a valve 45. The service station operates by directing the print cartridge 14 over the cup 42 where a vacuum in drawn on the nozzles and the ink is sucked through the nozzles and out of the print cartridge.

Figure 2:
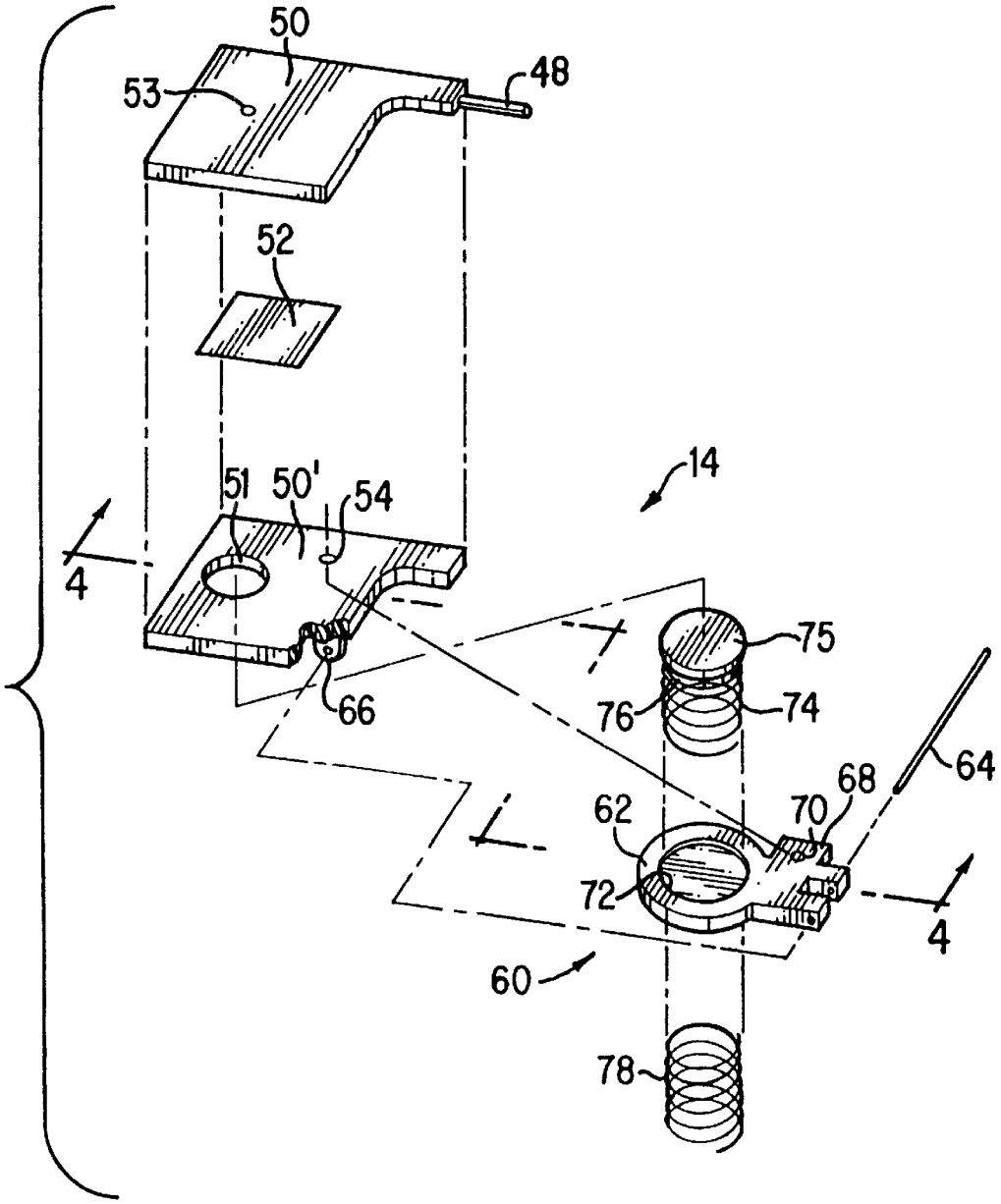
FIG. 2 is an exploded, perspective view of a portion of the print cartridge of FIG. 1.
Figure 3:
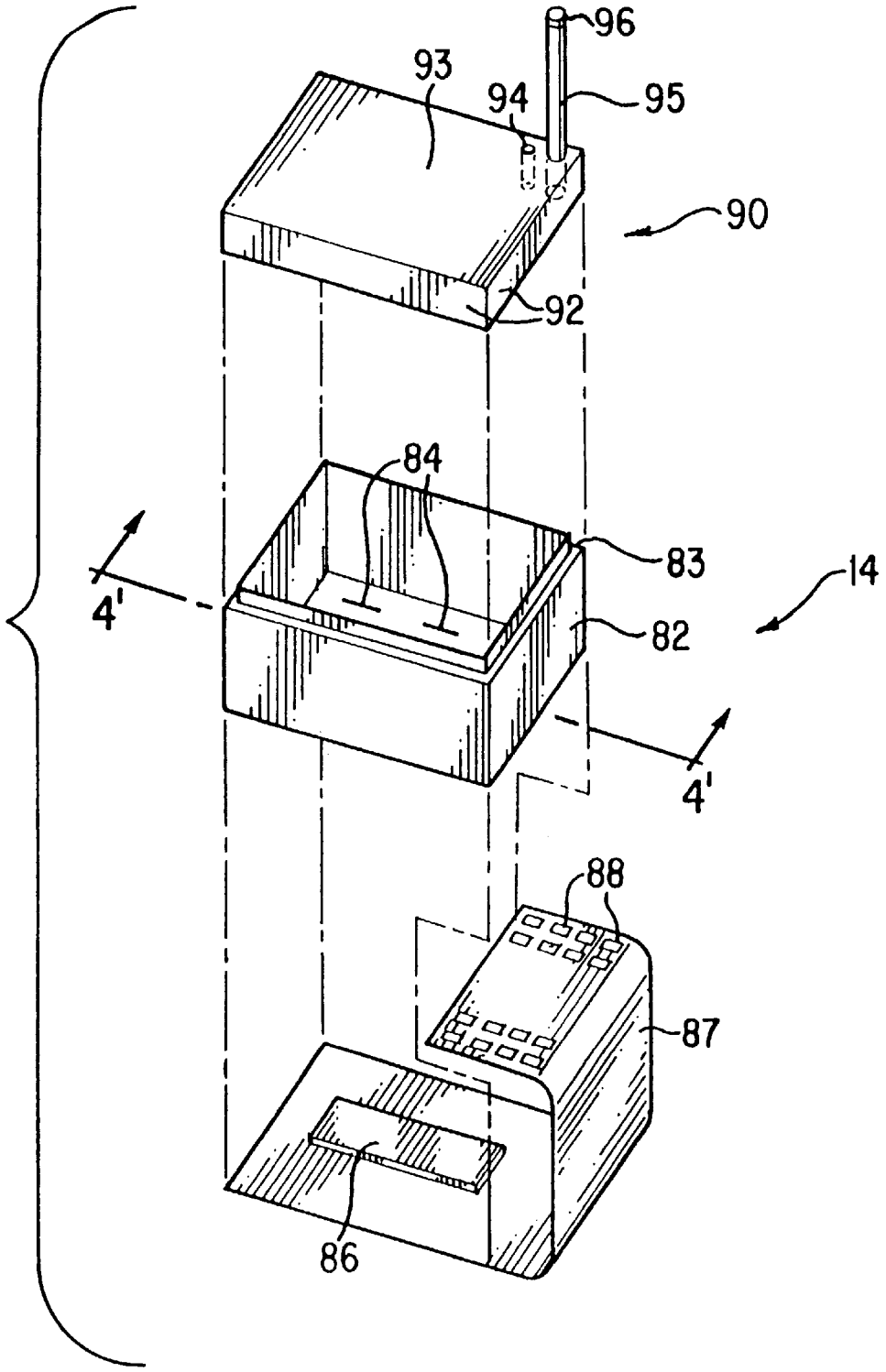
FIG. 3 is an exploded, perspective view of a second portion of the print cartridge of FIG. 1.
Figure 4:
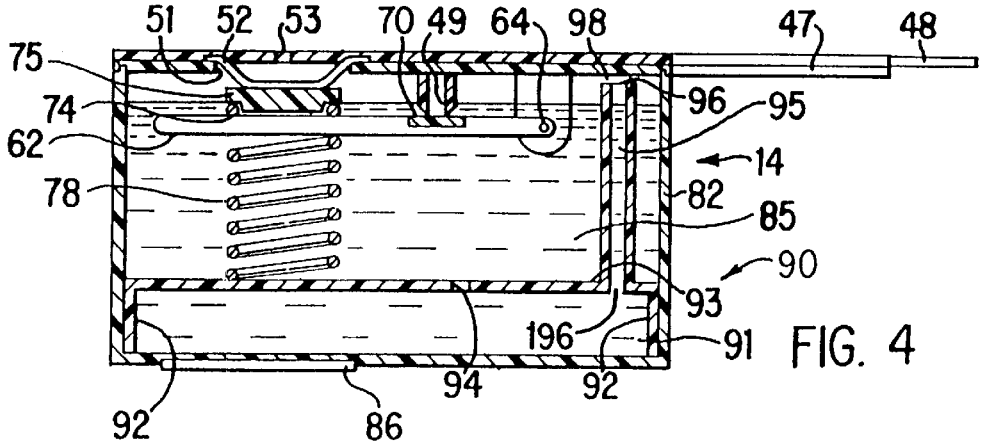
FIG. 4 is a side elevation view, in cross section taken along lines 4—4 and 4'—4' in FIGS. 2 and 3 respectively, illustrating the normal operating position of the pressure regulator.
Figure 5:
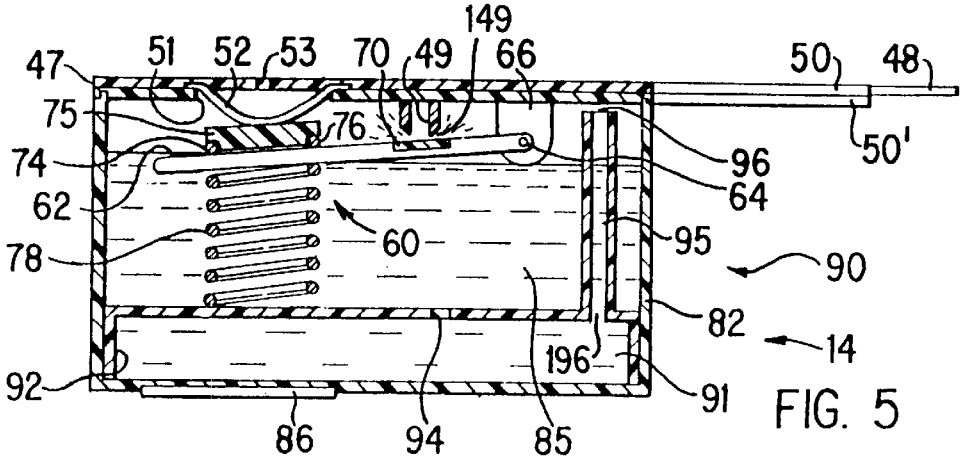
FIG. 5 is a side elevation view, in cross section taken along lines 4—4 and 4'—4' in FIGS. 2 and 3 respectively, illustrating the opening of the orifice of the pressure regulator to allow the entry of ink into the housing of the print cartridge.
Figure 6:
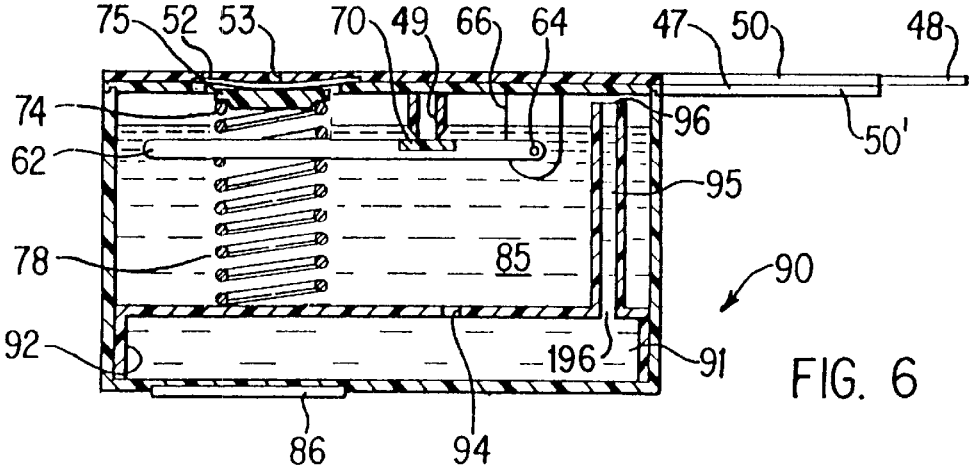
FIG. 6 is a side elevation view, in cross section taken along lines 4—4 and 4'—4' in FIGS. 2 and 3 respectively, illustrating the accumulator accommodating changes in the volume of ink.

The print cartridge 14 of FIG. 1 is shown in two exploded views in FIGS. 2 and 3. The print cartridge includes a top plate 47 that is formed from two contiguous, over-lapping flat panels 50, 50'. The panels form an interior hollow passage 54 for the ink within the top plate. This passage receives an intake tube 48, terminates at an orifice 49, FIG. 5, and distributes ink into the print cartridge. The upper panel 50 of the top plate contains a small vent 53 that communicates with the atmosphere. The lower panel 50' contains circular opening 51 of substantially larger diameter. Sandwiched and sealed between the panels 50, 50' is a diaphragm 52 that forms a fluid tight seal across the circular opening 51, FIG. 5. The peripheral margin of the diaphragm 52 is thereby sealed against both air and ink. The diaphragm can be fabricated from either thin polyethylene plastic or polyvinyldene fluoride so that the diaphragm is impervious to both air and ink. The diaphragm is deformable and flexible and may be either resilient or not. When a pressure difference is developed across the surface of the diaphragm, the diaphragm expands into the print cartridge as illustrated in FIGS. 4–6. The upper side of the diaphragm is continuously exposed to atmospheric pressure through the vent 53.

Referring to FIGS. 2 and 5, reference numeral 60 generally indicates a pressure regulator that supports the diaphragm 52 and regulates the pressure of ink supplied into the print head 14. The pressure regulator includes a lever 62 that rotates about an axle 64 that is supported from two supports 66. The supports are mounted on the underside of the lower panel 50' of the top plate 47. The lever also includes an integral arm 68 that contains a valve seat 70 for the ink orifice 49. The valve seat is a flattened, planar surface of room temperature vulcanizing silicone (RTV) and is counter sunk into the surface of the integral arm 68. The lever is aligned so that when the lever 62 is parallel with the plane of the top plate 47, the valve seat 70 is seated and ink orifice 49 is thereby shut as illustrated in FIG. 4.

The lever 62, FIG. 2, engages the diaphragm 52 with a piston 75 and an accumulator spring 74. The accumulator spring 74 is mounted in a circular depression 72 in the lever so that the spring does not move off of the lever 62. The piston is attached to the spring 74 and is held in place by a peripheral, concave engaging surface 76. Referring to FIGS. 4, 5, and 6, the accumulator spring 74 is designed so that a differential pressure across the diaphragm 52 can cause the diaphragm to flex and the piston 75 to move reciprocally up and down without moving the lever 62 and opening the ink inlet valve 49, 70. In FIG. 4 the diaphragm 52 is contracted slightly downward or is more concave in shape. In FIG. 6 the diaphragm is contracted slightly upward or is more planar in shape. The illustrated motion shows a portion of the wall of the ink containment moving and pushing any air bubbles that may be present toward the air collection area 98 of the print cartridge. This is an important aspect of air management within the print cartridge.

In FIG. 5 the ink valve 49, 70 opens when the piston 75 is forced sufficiently downward by the diaphragm to bottom out against the lever 62 and to mechanically cause its motion. The lever 62 is supported within the print cartridge 14 by a pressure setting spring 78. The pressure setting spring 78 is designed so that its force on the lever 62 is equal to the opening force or cracking force on the ink valve 49, 70. The pressure thereby developed is P0 or the cracking pressure of the regulator. The force of the pressure setting spring is set to be equal to the area of the diaphragm 52 that is uncovered by the opening 51, FIG. 2, multiplied by the pressure difference between atmospheric pressure and the pressure of the ink supplied to the print head 86, FIG. 5. Typically, this differential pressure is approximately minus three inches (−3") of water. The pressure setting spring 78 is also preloaded so that the force on the lever 62 essentially constant over the travel of the lever. Such a constant spring force causes the motion of the lever to be large for any given change in the cracking pressure. In other words, a small change in pressure will cause a large movement in the lever. The net result is that when the valve seat 70 is moved off the valve nozzle 49 by a distance equal to approximately the radius of the nozzle 49, the valve will open to full flow condition.

Referring to FIG. 3, the print cartridge 14 further includes a housing 82 that receives the top plate 47 in a step 83 formed in the end of the side walls of the housing. The housing and the top plate together comprise the ink containment for the print head 86. The ink containment includes a main ink chamber 85 and a plenum 91 described below. The ink containment as well as the conduit 34, FIG. 1, and the ink reservoir 30 are fabricated from materials that are impervious to both air and ink such as polysulphone, polyvinyldene fluoride, and liquid crystal polymers.

In the bottom wall of the housing 82 are a plurality of ink feed slots 84 that allow the ink to flow to the print head 86. The print head is a semiconductor substrate on to which are placed the firing chambers, the firing resistors, and the orifice plate in the conventional manner. The print head is mounted on a flexible conductor 87 by tab bonding and electrical signals to the firing resistors are established through the conductors 88, FIGS. 1 and 3. When the print head is ejecting drops of ink, it is in effect pumping the ink out of the print cartridge and the pressure regulator 60 strives to develop and maintain a pressure P0. In the plenum, due to flow induced pressure drops, a lower pressure of P1 exists (slightly more negative that P0).

The print cartridge 14 is designed to entrap and to warehouse any air in the cartridge in the area 98. Air and air bubbles rise vertically to the top of the print cartridge to the predetermined area 98. Air is thus stored in an out of the way location so that air and air bubbles do not interfere with the flow of ink during printing.

Referring to FIG. 3, reference numeral 90 generally indicates a priming assembly for removing air from the interior of the print cartridge 14. The priming assembly includes four side walls 92 and a top wall 93 that form a plenum 91 around the print head 86. These walls also support the pressure setting spring 78 above the bottom wall of the housing 82. The top wall 93 includes two conduits that both communicate with the plenum 91. One conduit includes a flow orifice 94 and communicates between the main ink chamber 85 and the plenum 91. The other conduit is a snorkel 95 with an inlet 96 that connects the plenum 91 with an area 98 in the print cartridge where air is collected. The flow orifice 94 is sized so that during all printing operations the ink flows to the print head 86 through the orifice 94 and not through the snorkel 95. The orifice is sized so that when printing at maximum ink flow, the orifice has a pressure drop through it that is less than the height L of the snorkel 95. In one embodiment actually constructed the flow orifice 94 had a diameter of forty thousands of an inch (0.040") and the snorkel 95 had an inside diameter of eighty thousands of an inch (0.080").

Figure 7:
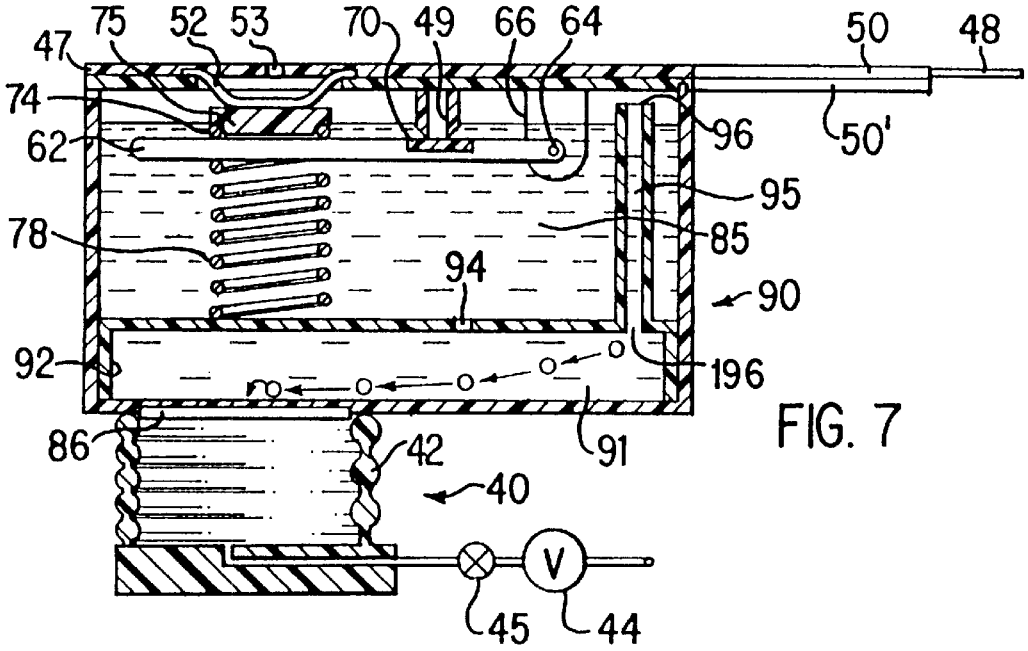
FIG. 7 is a side elevation view, in cross section taken along lines 4—4 and 4'—4' in FIGS. 2 and 3 respectively, illustrating the service station drawing air down the snorkel and out of the print head.

The priming assembly 90, FIG. 7, also includes the service station 40 described above which can engage and seal the print head 86. The service station develops a differential pressure P2−P0 across the plenum and draws ink out through the print head 86 at a much higher flow rate than during any printing operation. The flow orifice 94 is sized so that under this high ink flow condition, such a large pressure drop is developed across the flow orifice 94 that the ink and air in the top area 98 of the print cartridge are drawn down the snorkel 95 and out the print head 86 as illustrated in FIG. 7.

In operation, the ink reservoir 30, FIG. 1 and the print cartridge 14 are initially filled with ink and sealed. The ink conduit 34 may or may not be filled with ink. To begin, the ink reservoir 30 is connected to the ink conduit 34 by the double acting valve 36. When the printer 12, FIG. 1, commands the print cartridge 14 to commence ejecting drops 16, FIG. 1, ink flows through the conduit 34 and any air in the conduit flows into the print cartridge and becomes trapped in the top area 98 of the housing. As illustrated in FIG. 4, at this point the print cartridge has a slight air bubble 98 in the top of the housing, the ink orifice 49 is shut by the lever 62, the diaphragm 52 is slightly concave, and any ink flow to the print head 86 is passing through the flow orifice 94.

As the print head 86, FIG. 5 continues to eject drops of ink on command from the printer, the pressure of the ink in the print cartridge 14 starts to drop. The differential pressure across the plenum 91 goes more negative. The diaphragm 52 becomes more concave due to differential pressure between atmospheric pressure in the vent 53 and the pressure in the main in chamber 85. This drop in pressure continues until the piston 75, FIG. 5, bottoms out against the lever 62 and then the diaphragm forces the piston to move the lever and to open the orifice 49 as illustrated in FIG. 5. This is rotational motion of the lever 62 around the axle 64, FIG. 5. The point at which the orifice 49 opens is the "cracking pressure" and is determined by the pressure setting spring 78. Ink then flows into the print cartridge 14, the pressure is in the print cartridge is restored, and any air is collected in the area 98. When the differential pressure across the diaphragm 52 decreases due to the inflow of the ink, the piston 75 allows the lever to shut the orifice 49 and the flow of ink into the print cartridge stops.

In the immediately above described process, the ink flow path through the print cartridge is first into the intake 48 of the top plate 47, FIG. 2, through the passage 54, FIG. 2, out the orifice 49, FIG. 5, into the main ink chamber 85, through the flow orifice 94, into the plenum 91, and out the print head 86.

If the temperature of the print cartridge goes up due, for example, to operation of the print head, this could cause either the pressure of the air in the housing 82 to rise or the volume of air to increase. As discussed above, a wall portion of the ink containment moves to accommodate this increase in temperature. The diaphragm 52 flexes upward as illustrated in FIG. 6 and becomes more planar to maintain the pressure within the housing constant. If there is a decrease in temperature, the diaphragm flexes downward and becomes more concave to maintain constant pressure. This is relative motion between the piston 75 and the lever 62 and is permitted by the accumulator spring 74. The lever 62 remains stationary and is unaffected by such temperature excursions.

Figure 8:
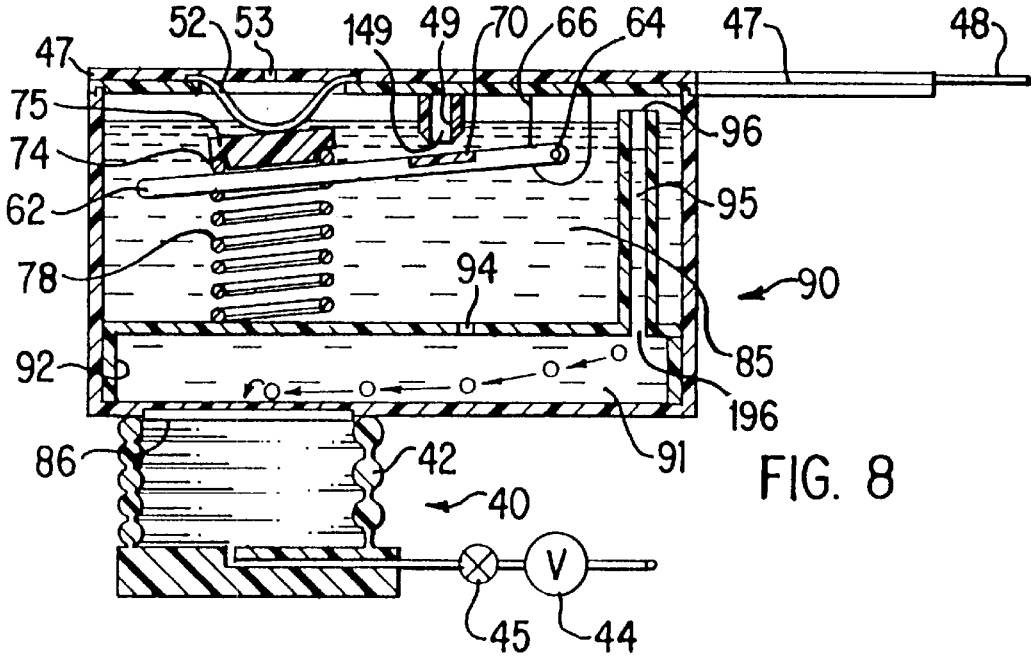
FIG. 8 is a side elevation view, in cross section taken along lines 4—4 and 4'—4' in FIGS. 2 and 3 respectively, illustrating the service station drawing air down the snorkel and out of the print head as the orifice of the pressure regulator opens to allow the entry of ink into the housing of the print cartridge.

To remove air trapped in the top area 98 of the print cartridge 14, the print cartridge is purged using the service station 40. Referring to FIGS. 7 and 8, a source 44 of vacuum is applied to the nozzles of the print head 86, a pressure P2 is developed in the plenum 91, and a very high ink flow rate is induced through the print cartridge. Any air in the print cartridge is drawn down the snorkel 95 as illustrated in FIG. 7 instead of through the flow orifice 94 because of the small size of the flow orifice and the large pressure drop across it. The volume of air drawn down the snorkel and out of the housing is replaced by a fluid volume of ink because the differential pressure in the housing drops and the orifice 49 opens as illustrated in FIG. 8. The result is to rapidly prime the print cartridge with ink and to remove the air from the system.

In the immediately above described process, the flow path of air and ink is from the predetermined air collection area 98, through the inlet 96, down the snorkel 95, into the plenum 91, out the print head 86, and into the service station 40.

It is contemplated that while there are a plurality of ways to remove air from the system using a source of vacuum, care should also be taken to minimize the amount of ink removed during the air removal process. Any excess ink so removed is ink unavailable for printing, and any ink so removed now needs itself to be warehoused. To minimize the removal of ink while removing air, a piston can be applied to the nozzles to draw down only a predetermined volume of the print cartridge. This would automatically limit the volume of ink and air removed from the print cartridge. As an alternative the source of vacuum could be timed with either a cam or clock to limit the application of vacuum to the nozzles.

It should be appreciated that there is a first conduit, the snorkel 95, FIG. 4, that communicates with the predetermined collection area 98 for air and a second conduit that contains the flow orifice 94 which communicates between the main ink chamber 85 and the plenum 91. Further, when a differential pressure P1−P0 is developed across the plenum by the pressure regulator 60 and the print head 86, ink is directed through the ink flow path in the print cartridge including the second conduit. When a differential pressure P2−P0 is developed across the plenum by the service station 40, FIG. 7, air from the collection area is removed from the print cartridge through the first conduit. Thus, by selectively altering the differential pressure across the plenum 91 between P1−P0 and P2−P0, the flow of fluid within the print cartridge is selectively shifted between the first and second conduits.

Figure 9:
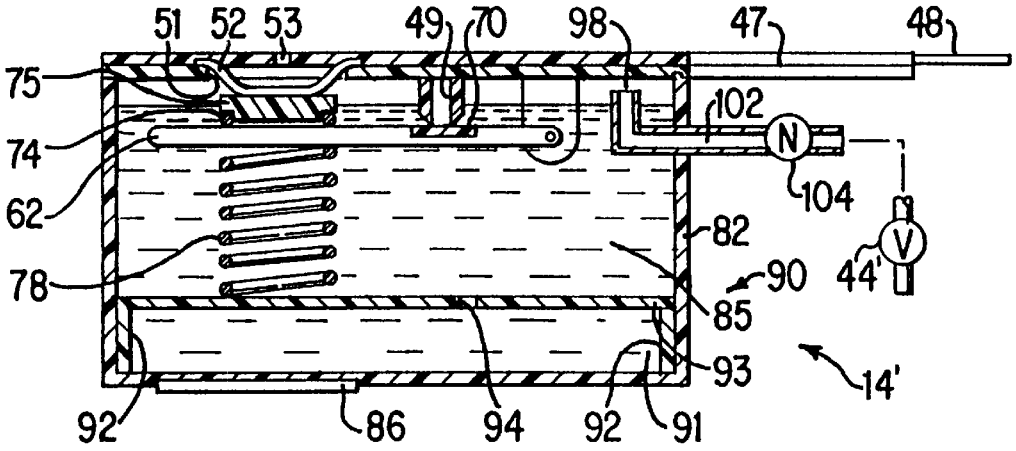
FIG. 9 is a side elevation view, in cross section, of a print cartridge according to an alternative embodiment of the present invention.

Referring to FIG. 9, reference numeral 14' generally indicates an alternative embodiment of the present invention. The conduit that communicates with the predetermined air collection area 98 is a conduit 102 that passes through a wall of the main ink chamber 85. This conduit contains a check valve 104 or "duck billed" valve that prevents the entry of air into the print cartridge. This conduit also is connectable to a source 44' of vacuum for drawing off the air from the air collection area.

Figure 10:
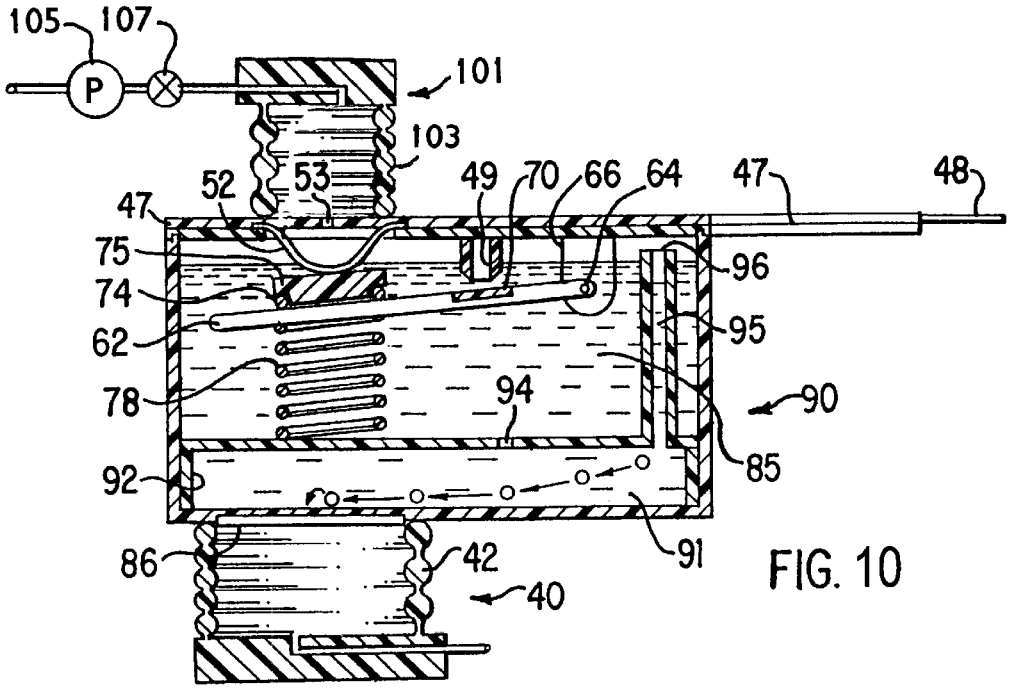
FIG. 10 is a side elevation of an alternative embodiment, in cross section essentially taken along lines 4—4 and 4'—40' in FIGS. 2 and 3 respectively, illustrating a service station providing pressure to a diaphragm to force accumulated air out of the printhead as the orifice of the pressure regulator opens to allow the entry of ink into the housing of the print cartridge.

Referring to FIG. 10, a pressurizing unit 101 is coupled to the vent 53 of the print cartridge in a second alternative embodiment. A second deformable cup 103 is applied to the print cartridge and a source of pressure 105 is directed through a valve 107 to the vent 53. This positive pressure is applied to the "reference" side of the diaphragm 53, which responsively expands into the print cartridge as shown in FIG. 10. The piston 75 is forced against the pressure setting spring 78 and contacts the regulator 60. Since the pressure generated by the source of pressure 105, P3, is greater than the cracking pressure, P0, of the pressure setting spring 78, the lever 62 of the regulator rotates about the axle 64 and separates the valve seat 70 from the ink orifice 49. Ink flows into the print cartridge and the pressure inside of the print cartridge is increased to a pressure P3, sufficient to force ink and trapped air within the print cartridge out of the nozzles and into the service station cup 42.

Figure 11:
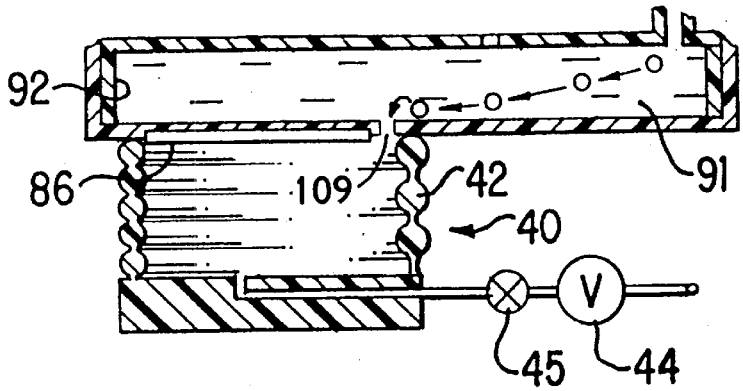
FIG. 11 is a portion of the side elevation of FIG. 8 illustrating the use of a non-emitting nozzle to enable the removal of air.

To avoid leaving air in one or more nozzles or the ink channels leading to the nozzles (thereby depriving the nozzles and resulting in their inability to eject ink when printing), one embodiment of a printhead is equipped with additional non-emitting nozzles having larger orifice than the ink ejecting nozzles. For example, the non-emitting nozzle orifice can have a diameter 2 times the emitting nozzle orifice diameter. In the embodiment employing vacuum to remove trapped air, the nozzle pressure of the non-emitting nozzles would be required to be lower (closer to zero) than the ink ejecting nozzles. Nearly all of the air that would otherwise deprive the ink ejecting nozzles flows through the non-emitting nozzles, thereby reducing the possibility of ink ejecting nozzles being deprimed. The non-emitting nozzles would ultimately serve as a check valve, keeping the inside of the inkjet cartridge isolated from ambient air. While it is desirable to have the non-emitting nozzles in the printhead, it is a realizable alternative to create the non-emitting nozzles in the body of the print cartridge near the printhead and in a location such that the service station cup 42 encompasses the non-emitting nozzles 109, as illustrated in FIGS. 11 and 13.

Figure 12:
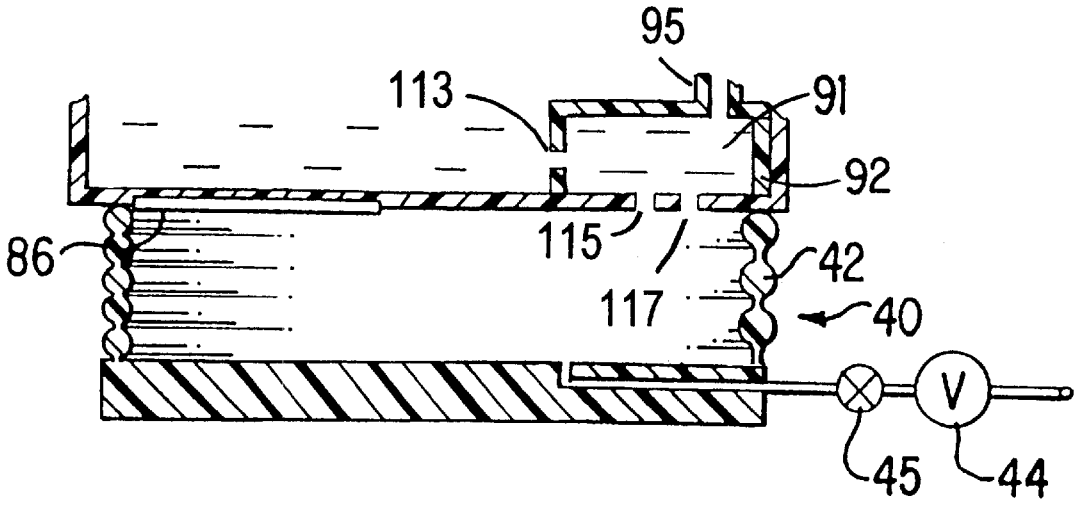
FIG. 12 is a portion of the side elevation of FIG. 8 illustrating the use of a non-emitting nozzle in the cartridge body coupled to an independent plenum and snorkel to enable the removal of air.

In another implementation the plenum 91 is arranged to cover only the non-emitting nozzles (whether on the printhead or adjacent to it). In this implementation only ink is extracted through the printing nozzles, (via the pump 44 and cup 42; or alternatively by virtue of applying air pressure to vent 53, opening the regulator valve). Such an implementation is shown in FIG. 12, where the plenum 91 contains a small orifice 113 (in the preferred embodiment having an orifice diameter of 0.040 inch) to equilibrate fluid heights when the print cartridge is not being primed and to keep the non-emitting nozzles 115, 117 wet so they act as a check valve. The snorkel 95 is coupled to the plenum 91 as previously described.

In normal printing operation the emitting nozzles are fired as commanded but the snorkel 95 and the plenum 91 do not participate the non-emitting nozzles 115, 117 are full of ink and their capillary pressure keeps air from being sucked back into the cartridge body. During priming, the cup 42 covers both sets of nozzles and a vacuum is applied (or alternatively, pressure is applied to 53, opening the regulator valve and pressurizing the pen chamber 85). Any air reachable by the snorkel 95 is rapidly removed and replaced by ink. Before the normal nozzles have access to air, the pen refills with ink.

Figure 13:
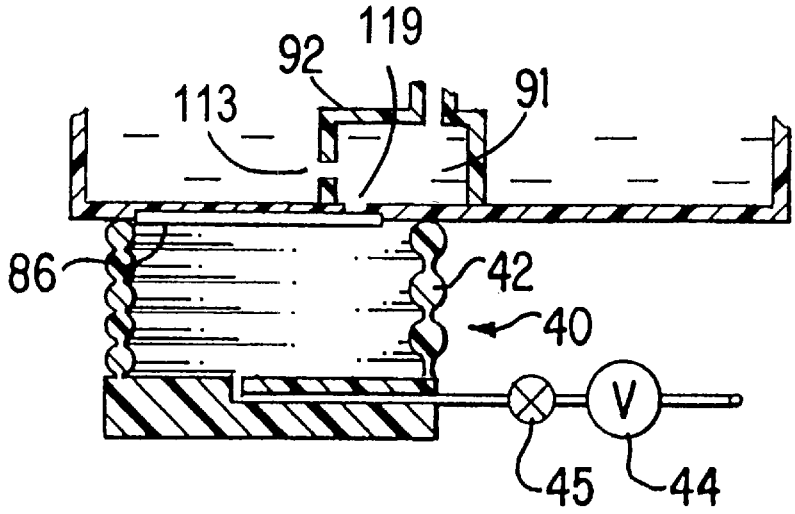
FIG. 13 is a portion of the side elevation of FIG. 8 the use of a non-emitting nozzle in the printhead coupled to an independent plenum and snorkel to enable the removal of air.

FIG. 13 illustrates the use of the isolated plenum technique of FIG. 12 as applied to the printhead-located non-emitting nozzles. An opening 119 couples the plenum 91 to the non-emifting nozzles (not shown) of printhead 86. Again, when a vacuum is applied (or pressure exerted) air is removed by way of the non-emitting nozzles and the snorkel rather than by the emitting nozzles.

Although specific embodiments of the invention have been described and illustrated, the invention is not be limited to the specific forms or arrangement of parts so described and illustrated herein. The invention is limited only by the claims.

What is claimed is:

1. An inkjet system, including an ink reservoir coupled to an inkjet pen cartridge and having apparatus for removing air from the inkjet cartridge, comprising:

an inkjet cartridge housing having a plurality of chambers for containing liquid ink therein;

a print head mounted to a bottom region of said housing;

a first ink chamber within said housing having a collection area for collection of unwanted air within said housing at a top region of said first ink chamber opposite said bottom region;

a second ink chamber within said housing adjacent said first ink chamber and fluidically connected to said first chamber for receiving ink therefrom;

a conduit mounted within said housing and coupling said second ink chamber with said collection area by having a first end at said second ink chamber and a second end within said collection area; and a vacuum source selectively engageable with said housing and drawing off said unwanted air from said collection area by drawing said unwanted air through a non-emitting nozzle at said bottom region so that said unwanted air is removed from the cartridge.

2. An inkjet system, including an ink reservoir coupled to an inkjet cartridge and having apparatus for removing air from the inkjet cartridge, comprising:

an inkjet cartridge housing having a plurality of chambers for containing liquid ink therein;

a print head mounted to a bottom region of said housing;

a first ink chamber within said housing having a collection area for collection of unwanted air within said housing at a top region of said first ink chamber opposite said bottom region;

a second ink chamber within said housing adjacent said first ink chamber and fluidically connected to said first chamber for receiving ink therefrom;

a conduit mounted within said housing and coupling said second ink chamber with said collection area by having a first end at said second ink chamber and a second end within said collection area; and a vacuum source, selectively engageable with said housing and drawing off said unwanted air from said collection area by drawing said unwanted air through a non-emitting nozzle in said print head so that said unwanted air is removed from the cartridge.

3. An inkjet system, including an ink reservoir coupled to an inkjet cartridge and having apparatus for removing air from the inkjet cartridge, comprising:

an inkjet cartridge housing having a plurality of chambers for containing liquid ink therein;

a print head mounted to a bottom region;

a first ink chamber within said housing having a collection area for collection of unwanted air within said housing at a top region of said first ink chamber opposite said bottom region;

a second ink chamber within said housing adjacent said first ink chamber and fluidically connected to said first chamber for receiving ink therefrom;

a conduit mounted within said housing and coupling said second ink chamber with said collection area by having a first end at said second ink chamber and a second end within said collection area; and a pressure source, selectively engageable with said housing for driving said unwanted air from said collection area so that said unwanted air is removed from said bottom region of said housing of the cartridge by way of said conduit and said second ink chamber.

4. The system of claim 3 wherein said pressure source further comprises a pressurizing unit that removes air from the cartridge by forcing said unwanted air through the print head.

5. The system of claim 3 wherein said pressure source further comprises a pressurizing unit that removes air from the cartridge by forcing said unwanted air through at least one orifice disposed in said bottom region of said housing of the cartridge.

6. The system of claim 3 wherein said pressure source further comprises a service station connectable to said print head for applying an air pressure thereon.

7. An apparatus for removing air from an inkjet print cartridge having an ink flow path therethrough, comprising:

a first ink accumulation chamber within said cartridge having means for receiving ink therein;

a second ink accumulation chamber adjacent said first ink accumulation chamber;

a predetermined collection area for air within said first ink accumulation chamber, said print cartridge having a pressure, P0, therein;

a vertical conduit of a predetermined height mounted within said cartridge and having an inlet in communication with said air collection area at a vertical conduit first end extending into said air collection area;

an aperture between said first ink accumulation chamber and said second accumulation chamber in said ink flow path, said aperture having a predetermined geometric configuration such that pressure drop across said aperture under a maximum ink flow condition during printing is less than a pressure head determined by the predetermined height of the vertical conduit;

a print head mounted on said cartridge and connected to the second ink accumulation chamber for pumping ink through the flow path in the print cartridge, a first differential pressure, P1–P0, is developed across the second ink accumulation chamber for the print head; and a pressure source, releasably engageable with the first ink accumulation chamber, for developing a second differential pressure, P3–P0, across the second ink accumulation chamber so that when said first differential pressure, P1–P0, is developed across the second ink accumulation chamber, ink flows through the aperture and does not flow through the vertical conduit and when said second differential pressure, P3–P0, is developed across the second ink accumulation chamber, air is forced down the vertical conduit and is removed from the flow path.

8. The system of claim 1 further comprising a pressure regulator that supplies ink from the ink reservoir to said first ink chamber and regulates ink pressure applied to said print head.

9. The system of claim 2 further comprising a pressure regulator that supplies ink from the ink reservoir to said first ink chamber and regulates ink pressure applied to said print head.

10. The system of claim 3 further comprising a pressure regulator that supplies ink from the ink reservoir to said first ink chamber and regulates ink pressure applied to said print head.

* * * * *